US009139392B2

(12) United States Patent
Aoki

(10) Patent No.: US 9,139,392 B2
(45) Date of Patent: Sep. 22, 2015

(54) MEDIUM TRANSPORTING DEVICE AND RECORDING APPARATUS

(71) Applicant: SEIKO EPSON CORPORATION, Tokyo (JP)

(72) Inventor: Takeshi Aoki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/486,087

(22) Filed: Sep. 15, 2014

(65) Prior Publication Data

US 2015/0091237 A1 Apr. 2, 2015

(30) Foreign Application Priority Data

Oct. 2, 2013 (JP) ..... 2013-207080
Oct. 2, 2013 (JP) ..... 2013-207081

(51) Int. Cl.

*B65H 15/00* (2006.01)
*B65H 85/00* (2006.01)
*B41J 3/60* (2006.01)
*B41J 13/00* (2006.01)

(52) U.S. Cl.

CPC . *B65H 15/00* (2013.01); *B41J 3/60* (2013.01); *B41J 13/0054* (2013.01); *B65H 85/00* (2013.01); *B65H 2301/31124* (2013.01); *B65H 2511/11* (2013.01)

(58) Field of Classification Search

CPC ..... B65H 15/00; B65H 85/00; B65H 2301/3112; B65H 2301/31224; B65H 2301/3122; B65H 2301/3123; B65H 2301/332; B65H 2301/333; B65H 2511/11
USPC ..... 271/186, 301, 291, 65; 399/364
See application file for complete search history.

(56) References Cited

U.S. PATENT DOCUMENTS 4,990,965 A * 2/1991 Kiya ..... 399/402
8,398,075 B2 * 3/2013 Nose et al. ..... 271/186

FOREIGN PATENT DOCUMENTS

JP 06144647 A * 5/1994 ..... B65H 7/10
JP 2012-240813 12/2012

* cited by examiner

*Primary Examiner* — Michael McCullough
(74) *Attorney, Agent, or Firm* — Workman Nydegger

(57) ABSTRACT

A medium transporting device includes a first roller that inverts a medium supplied from a processing section side, the processing section processing the medium; a second roller that is located closer to the processing section than the first roller, the second roller having a function of inverting the medium supplied from the processing section side and a function of applying a transporting force to the medium using an outer peripheral surface of the second roller that faces both a pre-inversion medium transporting pathway for transporting a medium that has not been inverted by the first roller and a post-inversion medium transporting pathway for transporting a medium that has been inverted by the first roller; a medium transporting pathway that causes the medium supplied from the processing section side to be inverted along the second roller and causes the medium thus inverted to be supplied to the processing section side.

10 Claims, 8 Drawing Sheets

MEDIUM TRANSPORTING DEVICE AND RECORDING APPARATUS

BACKGROUND

1. Technical Field

The present invention relates to a medium transporting device and a recording apparatus including the medium transporting device.

The term "recording apparatus" as used herein encompasses an ink jet printer, a line printer, a copying machine, a facsimile, and the like.

2. Related Art

Recording apparatuses represented by facsimiles and printers include those that are capable of performing two-sided recording on a recording sheet, which is one example of a medium. Such a recording apparatus has an inversion pathway on which a recording sheet inverted, as illustrated in JP-A-2012-240813, for example. A recording sheet is back-fed into the inversion pathway after recording is performed on its first face (front face). Then, the recording sheet is transported again to a region facing a recording head with its second face (rear face) facing upwards.

According to the recording apparatus described in JP-A-2012-240813, an inversion pathway is formed by utilizing an outer peripheral surface of a roller (hereinafter referred to as a "roller for inversion"). It is therefore necessary to increase the size of the roller for inversion in order to invert a large sheet such as an A3-size sheet.

However, in a case where the size of the roller for inversion is increased in order to invert a large sheet, a small sheet such as an A4-size sheet also is inverted with this roller for inversion, and this small sheet is transported through an inversion pathway designed for the large sheet.

Accordingly, the small sheet travels an extra distance when it is inverted on the inversion pathway. Consequently, the inversion pathway including this roller for inversion takes a longer time to invert a small sheet, resulting in a decline in throughput.

Moreover, in a case where this recording apparatus includes, for example, a front sheet feeding pathway for feeding a sheet from a front side of the recording apparatus and executing recording on the sheet in addition to a transporting pathway for transporting a sheet from a sheet cassette, the inversion pathway is used to transport a sheet P to the region facing the recording head where recording is performed on the sheet P.

As a result, a small sheet fed to the front sheet feeding pathway is also transported from the front sheet feeding pathway to the recording head via the inversion pathway. Accordingly, the small sheet travels a long distance. This results in a decline in throughput.

SUMMARY

An advantage of some aspects of the invention is to provide a medium transporting device and a recording apparatus that include an inversion pathway that allows media of different sizes to be inverted and allows an improvement in throughput of media transported from a plurality of medium transporting pathways.

A medium transporting device according to a first aspect of the invention includes: a first roller that inverts a medium supplied from a processing section side, the processing section processing the medium; a second roller that is located closer to the processing section than the first roller, the second roller having a function of inverting the medium supplied from the processing section side and a function of applying a transporting force to the medium using an outer peripheral surface of the second roller that faces both a pre-inversion medium transporting pathway for transporting a medium that has not been inverted by the first roller and a post-inversion medium transporting pathway for transporting a medium that has been inverted by the first roller; a first medium transporting pathway that causes the medium supplied from the processing section side to be inverted along the first roller and causes the medium thus inverted to be supplied to the processing section side; and a second medium transporting pathway that causes the medium supplied from the processing section side to be inverted along the second roller and causes the medium thus inverted to be supplied to the processing section side.

According to the first aspect, the medium transporting device includes (i) the first medium transporting pathway that causes the medium supplied from the processing section side to be inverted along the first roller and causes the medium thus inverted to be supplied to the processing section side and (ii) the second medium transporting pathway that causes the medium supplied from the processing section side to be inverted along the second roller located closer to the processing section than the first roller and causes the medium thus inverted to be supplied to the processing section side. This makes it possible to select a pathway for inverting the medium in accordance with the length of the medium in the transporting direction.

As a result, use of the second medium transporting pathway allows a medium having a short length in the transporting direction to be inverted with a shorter traveling distance and allows the medium to be transported in a shorter period of time, as compared with a case where the first medium transporting pathway is used. Consequently, the medium transporting device according to the first aspect allows sheets of different sizes to be inverted and allows an improvement in throughput.

A medium transporting device according to a second aspect of the invention includes: a first roller that inverts a medium supplied from a processing section side, the processing section processing the medium; a second roller that is located closer to the processing section than the first roller, the second roller having a function of inverting the medium supplied from the processing section side and a function of applying a transporting force to the medium using an outer peripheral surface of the second roller that faces both a pre-inversion medium transporting pathway for transporting a medium that has not been inverted by the first roller and a post-inversion medium transporting pathway for transporting a medium that has been inverted by the first roller; a first medium transporting pathway that causes the medium supplied from the processing section side to be inverted along the first roller and causes the medium thus inverted to be supplied to the processing section side; and a second medium transporting pathway that serves as a short-cut allowing the medium supplied from the processing section to travel between the first roller and the second roller and to be supplied to the processing section side.

According to the second aspect, the medium transporting device includes (i) the first medium transporting pathway that causes the medium supplied from the processing section side to be inverted along the first roller and causes the medium thus inverted to be supplied to the processing section side and (ii) the second medium transporting pathway that serves as a short-cut causing the medium supplied from the processing section side to travel between the first roller and the second roller and causes the medium thus inverted to be supplied to the processing section side. This makes it possible to select a pathway for inverting the medium in accordance with the length of the medium in the transporting direction.

As a result, use of the second medium transporting pathway that serves as a short-cut causing the medium supplied from the processing section side to travel between the first roller and the second roller allows a medium having a short length in the transporting direction to be inverted with a shorter traveling distance and allows the medium to be transported in a shorter period of time, as compared with a case where the first medium transporting pathway is used. Consequently, the medium transporting device according to the second aspect allows sheets of different sizes to be inverted and allows an improvement in throughput.

The medium transporting device according to the first aspect of the invention may further include a merging pathway that merges into the pre-inversion medium transporting pathway so that the medium is supplied to the second roller. The medium transported via the merging pathway is transported to the processing section through the second medium transporting pathway.

In this case, the medium supplied via the merging pathway travels a shorter distance and therefore can be transported in a shorter period of time, as compared with a case where the medium travels to the processing section through the first medium transporting pathway. As a result, it is possible to shorten a period of time required for recording on the medium supplied via the merging pathway and to improve the throughput of media supplied via the merging pathway.

The medium transporting device according to the first aspect may further include a transporting roller pair located between the processing section and the second roller. In a case where the length of the medium in a transporting direction is longer than the length of a pathway starting from the transporting roller pair, passing through the second medium transporting pathway and returning to the transporting roller pair, the medium supplied from the processing section side is transported by the first medium transporting pathway. Meanwhile, in a case where the length of the medium in the transporting direction is equal to or shorter than the length of the pathway starting from the transporting roller pair, passing through the second medium transporting pathway and returning to the transporting roller pair, the medium supplied from the processing section side is transported by the second medium transporting pathway.

In this case, in a case where the length of the medium in the transporting direction is longer than the length of a pathway starting from the transporting roller pair, passing through the second medium transporting pathway and returning to the transporting roller pair, the medium supplied from the processing section side is transported along the first medium transporting pathway, and in a case where the length of the medium in the transporting direction is equal to or shorter than the length of the pathway starting from the transporting roller pair, passing through the second medium transporting pathway and returning to the transporting roller pair, the medium supplied from the processing section side is transported along the second medium transporting pathway. This makes it possible to use a suitable one of these medium transporting pathways in accordance with the length of the medium. Consequently, it is possible to shorten a transporting distance of a medium having a length equal to or shorter than the length of the pathway starting from the transporting roller pair, passing through the second medium transporting pathway and returning to the transporting roller pair.

As a result, the medium having a length equal to or shorter than the length of the pathway starting from the transporting roller pair, passing through the second medium transporting pathway and returning to the transporting roller pair does not need to travel an extra distance. This makes it possible to shorten a period of time required for transportation of the medium having a length equal to or shorter than the length of the pathway starting from the transporting roller pair, passing through the second medium transporting pathway and returning to the transporting roller pair. Consequently, the medium transporting device in this case allows sheets of different sizes to be inverted and allows an improvement in throughput.

The medium transporting device according to the first aspect may further include a switching section provided between the first roller and the second roller, the switching section being switchable between a first posture in which the medium supplied from the processing section side is transported to the first medium transporting pathway and a second posture in which the medium supplied from the processing section side is transported to the second medium transporting pathway.

In this case, the medium transporting device includes a switching section that is provided between the first roller and the second roller and that is switchable between a first posture in which the medium supplied from the processing section side is transported to the first medium transporting pathway and a second posture in which the medium supplied from the processing section side is transported to the second medium transporting pathway. This makes it possible to switch a medium transporting pathway used to transport a medium in accordance with the length of the medium. As a result, the medium does not have to travel an extra distance, thereby the medium may be transported in a shorter period of time. Consequently, the medium transporting device in this case allows sheets of different sizes to be inverted and allows an improvement in throughput.

A recording apparatus according to a third aspect of the invention includes a processing section that processes a medium and the medium transporting device according to the first aspect.

A recording apparatus according to a fourth aspect of the invention includes a processing section that processes a medium; the medium transporting device according to the third aspect; a control section that controls the medium transporting device; and a detector that detects the medium, in which the merging pathway merges into the pre-inversion medium transporting pathway at a position closer to the processing section than the second roller, and the control section switches the first posture and the second posture of the switching section on the basis of the length, in the transporting direction, of the medium detected by the detector.

According to the fourth aspect, the control section switches the posture of the switching section on the basis of the information on the length of the medium detected by the detector. This produces an effect that it is possible to select a medium transporting pathway corresponding to the length of the medium, in addition to the effect produced by the medium transporting device according to the above aspect. Consequently, this recording apparatus allows sheets of different sizes to be inverted and allows an improvement in throughput.

In this case, the recording apparatus according to the aspect of the invention may be arranged such that the merging pathway merges into the pre-inversion medium transporting pathway at a position closer to the processing section than the second roller.

In this case, the merging pathway merges into the pre-inversion medium transporting pathway at a position closer to the processing section than the second roller. In addition to the effect produced by the third aspect, this allows the medium transported from the merging pathway to be transported to the processing section via the second medium transporting pathway. As a result, the length of a pathway from the merging pathway to the processing section becomes shorter than that in a case where the medium passes through the first medium transporting pathway. This allows the medium to be transported in a shorter period of time and allows an improvement in the throughput of media transported from the merging pathway.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
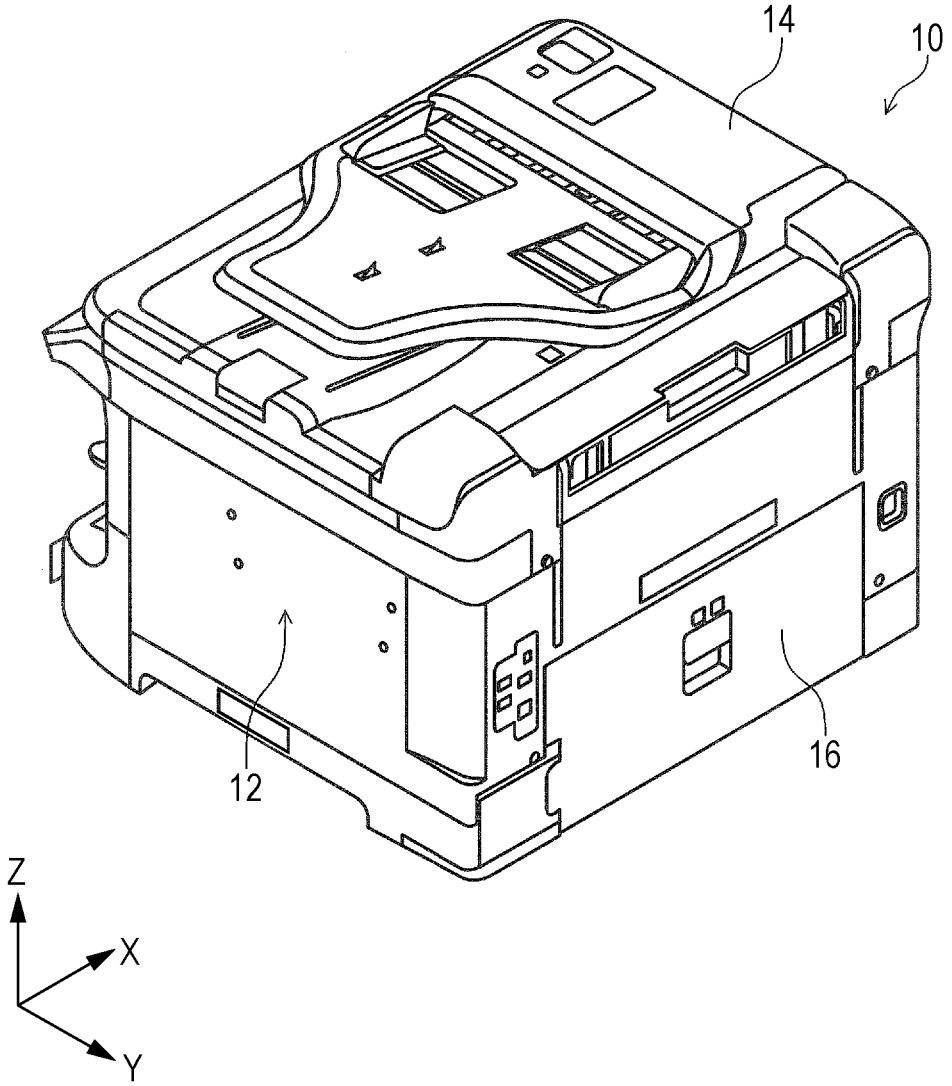
FIG. 1 is a perspective view illustrating a back side of a printer according to the invention.

An embodiment of the invention is described below with reference to the drawings. It should be noted that identical constituent members in different embodiments are given identical reference numerals, and they are explained only in the first embodiment and are not explained repeatedly in the subsequent embodiments.

Figure 2:
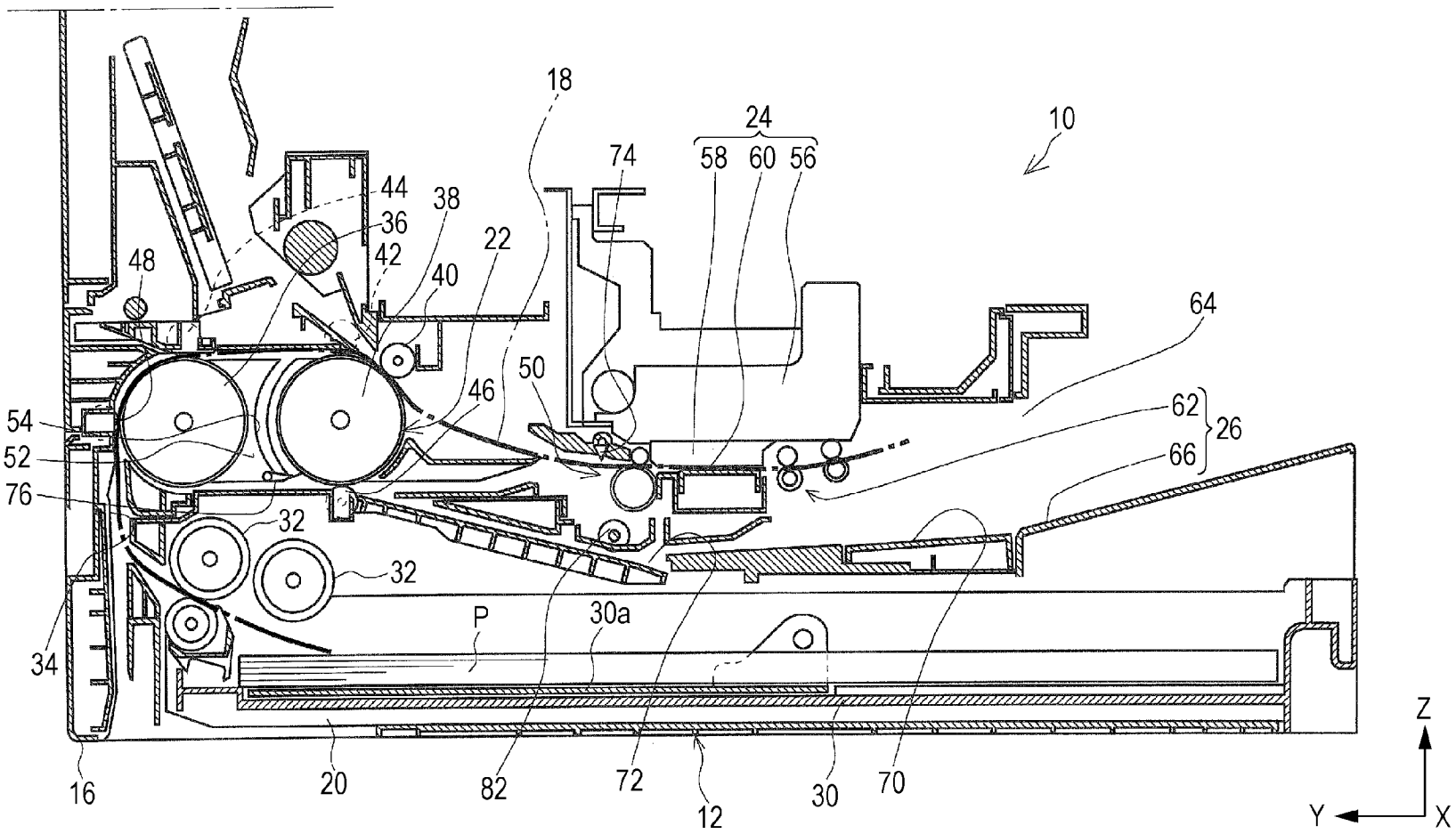
FIG. 2 is a sectional side view illustrating a pathway through which a medium is transported from a medium storage section in the printer according to the first embodiment of the invention.
Figure 3:
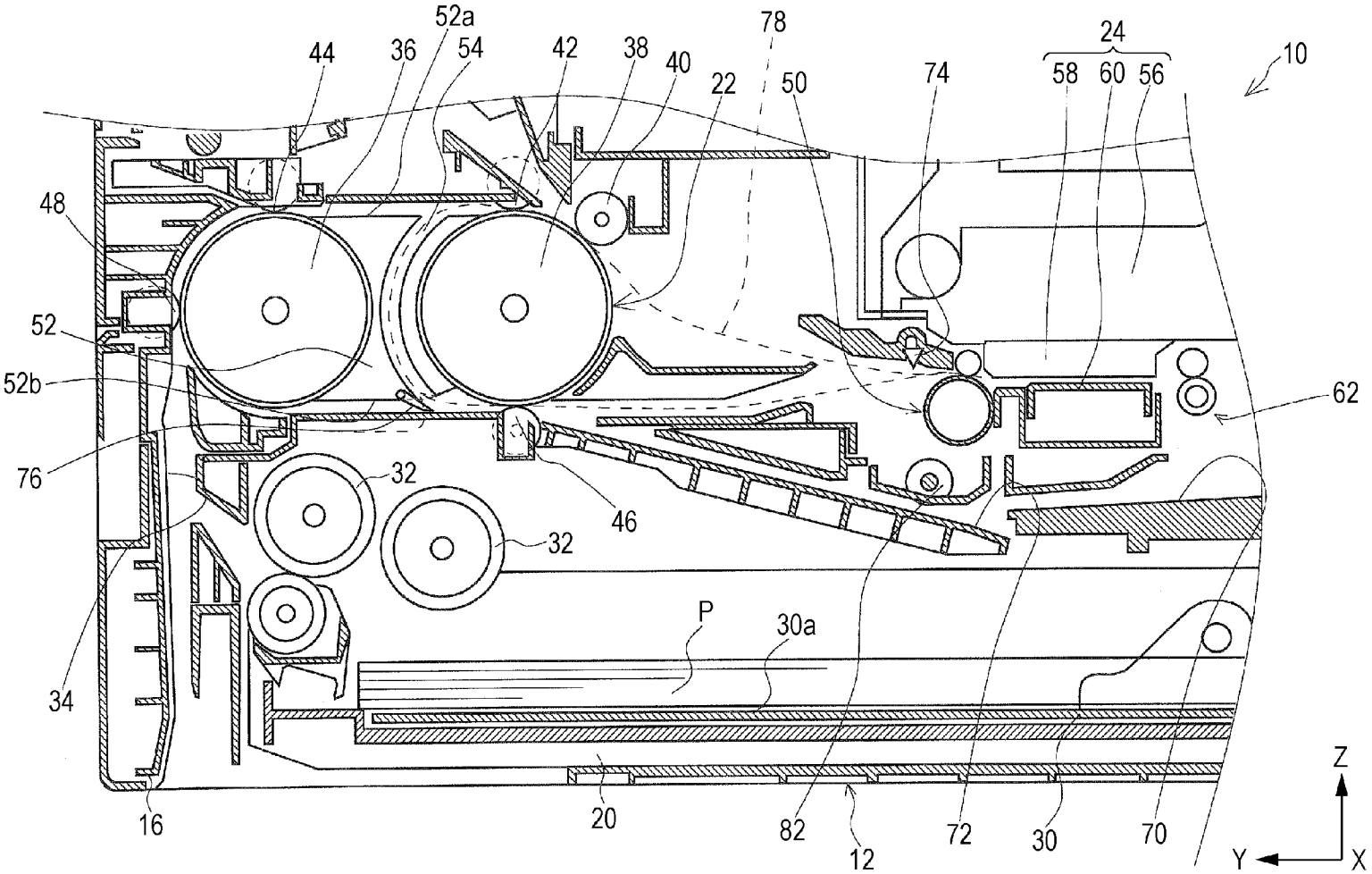
FIG. 3 is an enlarged view illustrating a portion around a transporting section according to the first embodiment.
Figure 4:
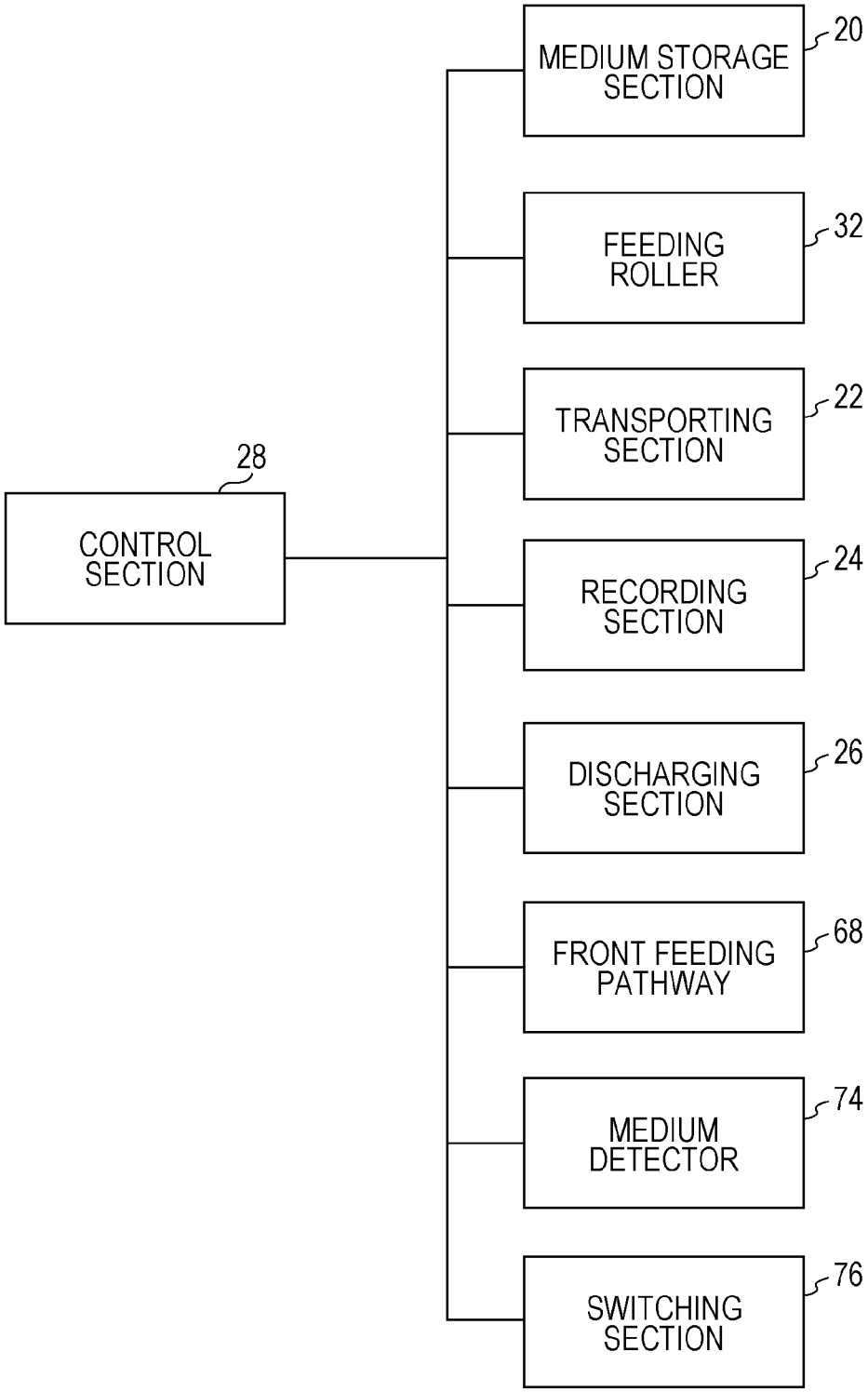
FIG. 4 is a control block diagram of the printer according to the invention.
Figure 5:
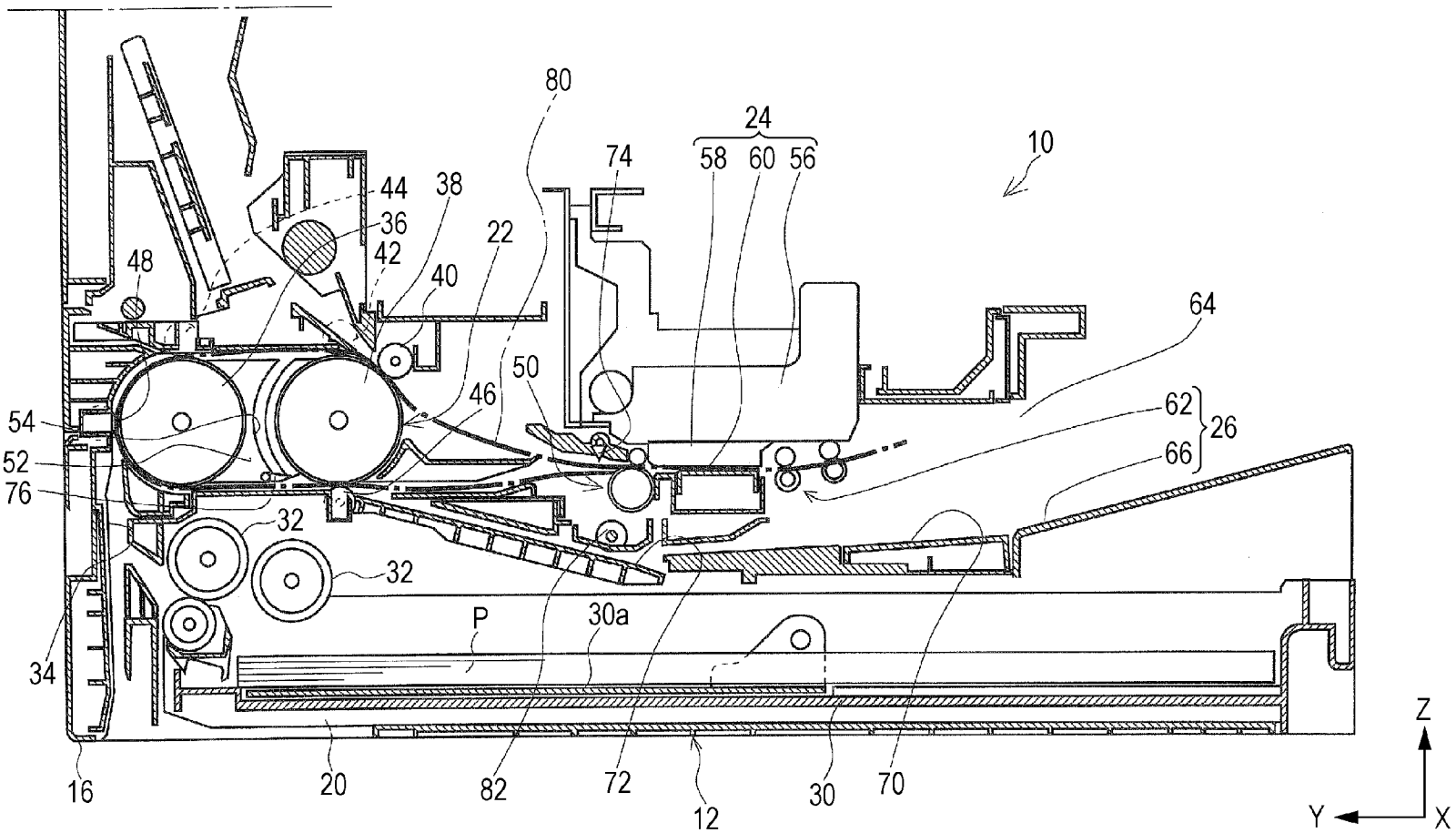
FIG. 5 is a sectional side view illustrating a first medium transporting pathway in the printer according to the first embodiment of the invention.

FIG. 1 is a perspective view illustrating a back side of a printer according to the invention. FIG. 2 is a sectional side view illustrating a medium transporting pathway for transporting a medium from a medium storage section of the printer according to the first embodiment of the invention. FIG. 3 is an enlarged view illustrating a portion around a transporting section according to the first embodiment. FIG. 4 is a control block diagram of the printer according to the invention. FIG. 5 is a sectional side view illustrating a first medium transporting pathway of the printer according to the first embodiment of the invention.

Figure 6:
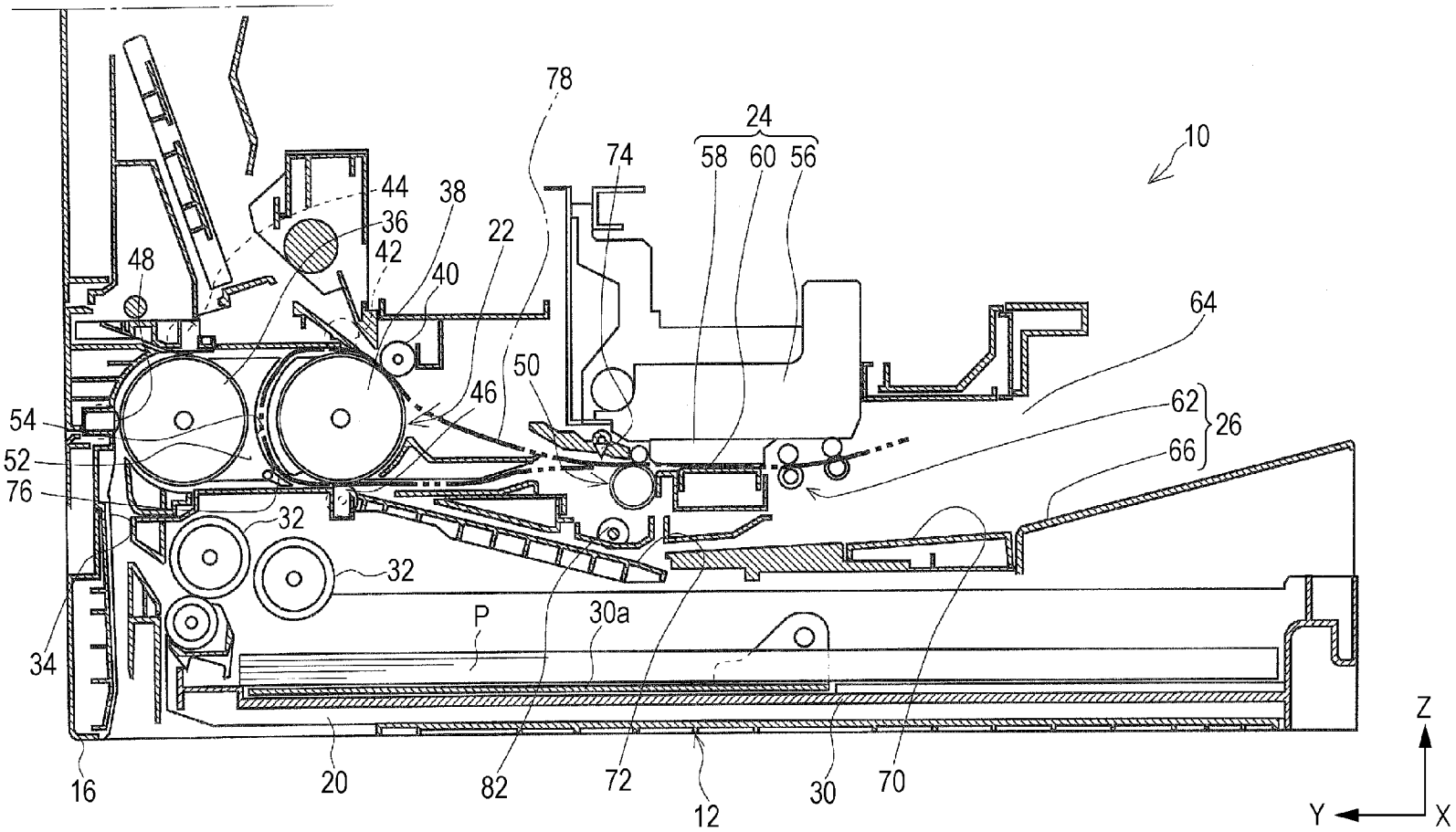
FIG. 6 is a sectional side view illustrating a second medium transporting pathway in the printer according to the first embodiment of the invention.
Figure 7:
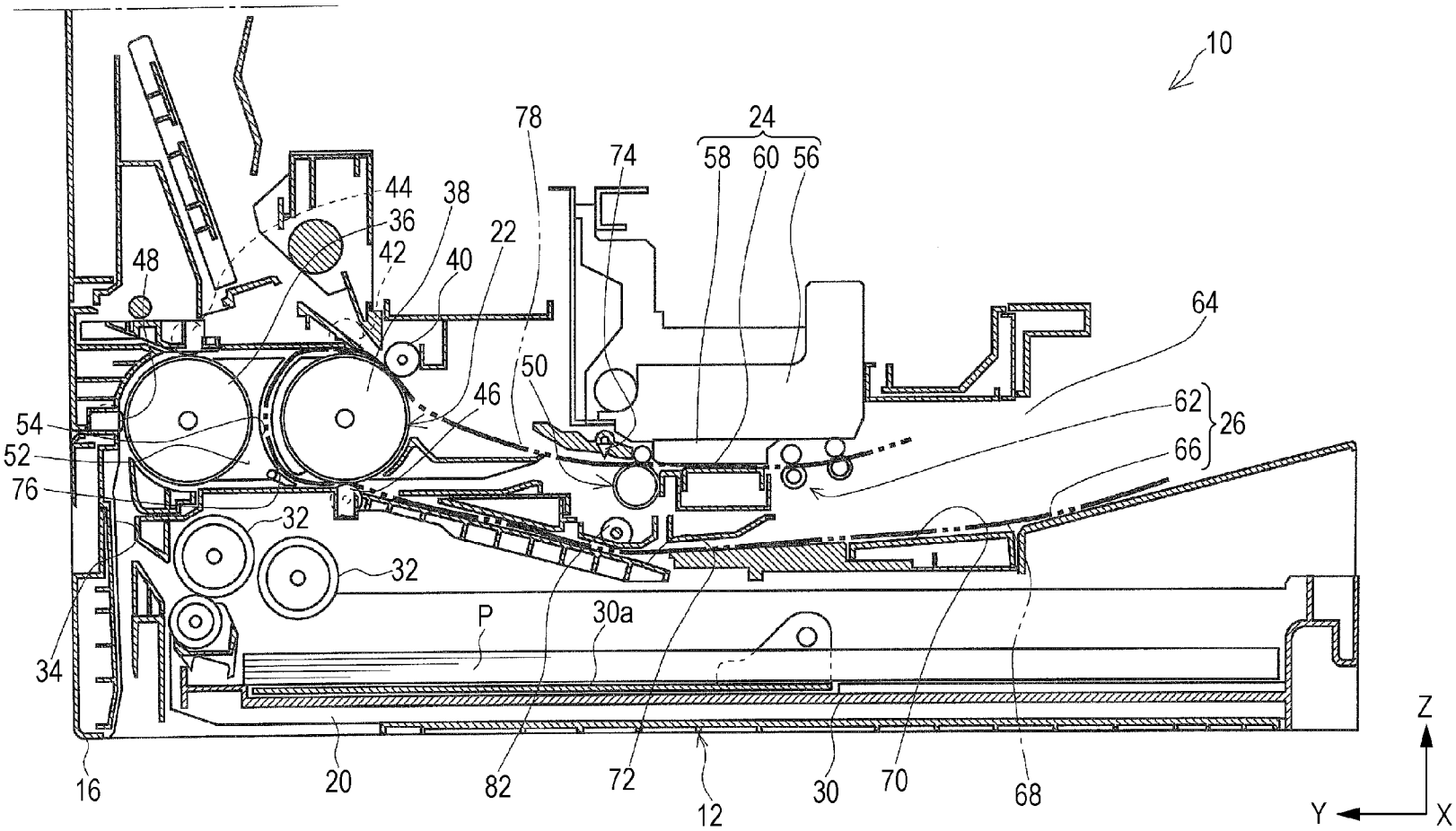
FIG. 7 is a sectional side view illustrating a medium transporting pathway for a medium transported from the front feeding pathway in the printer according to the first embodiment of the invention.
Figure 8:
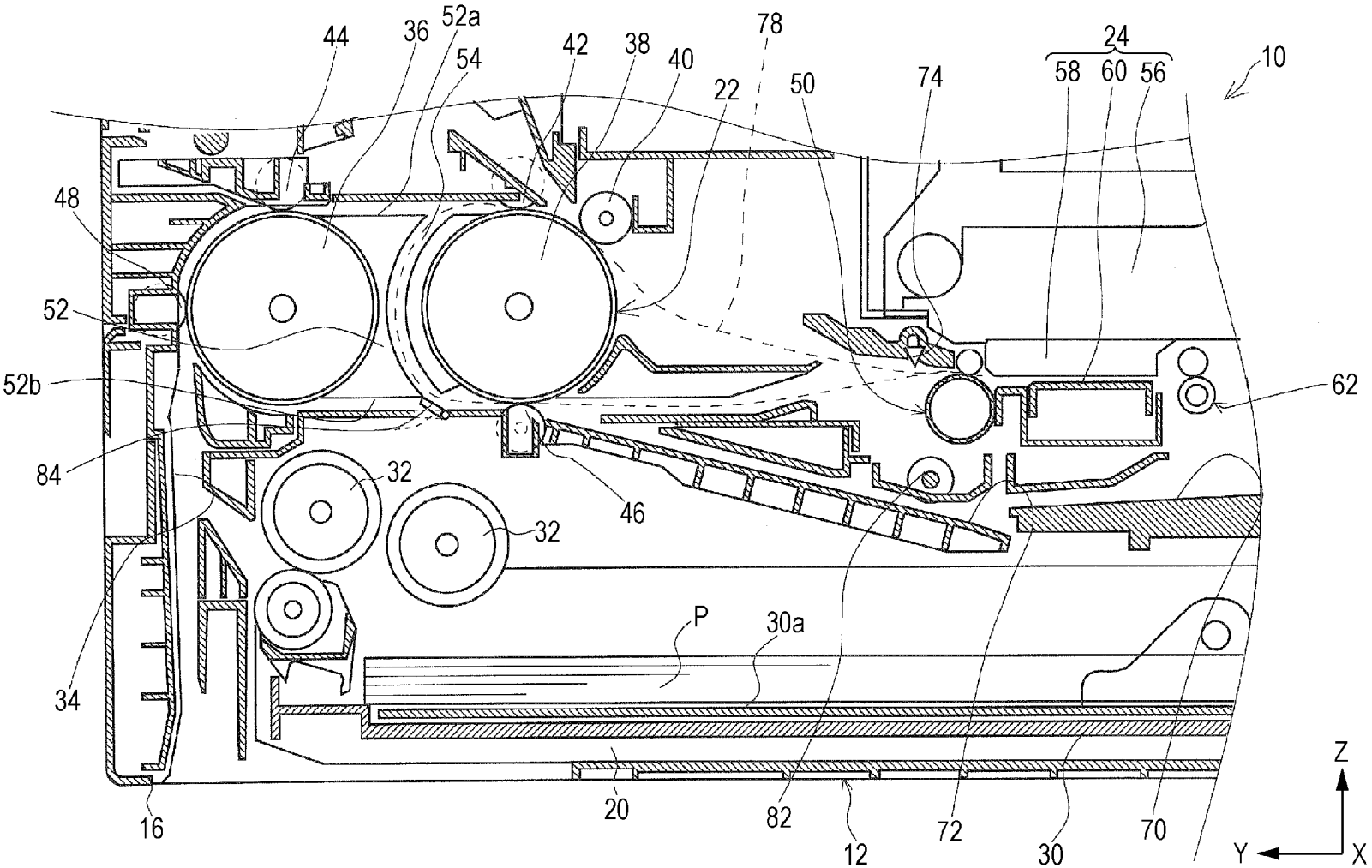
FIG. 8 is an enlarged view illustrating a portion around a transporting section according to a modification of the first embodiment.

FIG. 6 is a sectional side view illustrating a second medium transporting pathway of the printer according to the first embodiment of the invention. FIG. 7 is a sectional side view illustrating a medium transporting pathway for a medium transported from a front feeding pathway in the printer according to the first embodiment of the invention. FIG. 8 is an enlarged view illustrating a portion around a transporting section according to a modification of the first embodiment.

In the drawings which illustrate the X-Y-Z coordinate system, the X direction indicates a direction in which a recording head is scanned, the Y direction indicates a depth direction of the recording apparatus, and the Z direction indicates a direction in which a distance (gap) between the recording head and a medium changes, i.e., a height direction of the device. It should be noted that in the drawings, the −Y direction indicates the front side of the device and the +Y direction indicates the back side of the device.

Outline of Printer

FIG. 1 illustrates a printer 10 according to the invention. The printer 10 includes a device main body 12 and a document reading device 14 that is provided on an upper side of the device main body 12 so as to be movable rotationally with respect to the device main body 12. The device main body 12 includes, on the back side of the device (in the +Y direction in FIG. 1), a back cover 16 that is configured to be movable rotationally with respect to the device main body 12. It should be noted that FIG. 1 illustrates a state where the back cover 16 is closed with respect to the device main body 12.

Next, with reference to FIG. 2, the following describes a transporting pathway 18 for a sheet P, which is a "medium" in the printer 10. The printer 10 includes a medium storage section 20, a transporting section 22 serving as a "medium transporting device", a recording section 24 serving as a "processing section", a discharging section 26, and a control section 28 (see FIG. 4), each of which is provided in the device main body 12. It should be noted that the alternate long and short dash line given the reference numeral 18 in FIG. 2 represents the transporting pathway 18 for the sheet P that starts from the medium storage section 20, passes through the transporting section 22 and the recording section 24, and reaches the discharging section 26.

The medium storage section 20 includes a sheet cassette 30 located on the lower side in the Z direction in FIG. 1 in the printer 10. The sheet cassette 30 is configured to be attachable and removable from the front side of the device (on the −Y direction side in FIG. 2) with respect to the device main body 12.

Above the sheet cassette 30, feeding rollers 32 that are rotationally driven by a driving source (not shown) are provided. The sheet cassette 30 has a bottom plate 30*a*. The bottom plate 30*a* supports the sheet P and serves as a hopper urging the sheet P toward the feeding rollers 32 located in the +Z direction in FIG. 2.

Under the control of the control section 28 (see FIG. 4), the feeding rollers 32 rotate while being in contact with a top one of sheets P stored in the sheet cassette 30 so as to feed the top sheet P from the sheet cassette 30 to the downstream side of the transporting pathway.

In a state where the back cover 16 is in a closed state with respect to the device main body 12, an inner surface of the back cover 16 constitutes apart of the transporting pathway for the sheet P. That is, a feeding pathway section 34 formed inside the back cover 16 guides, to the transporting section 22 along the transporting pathway 18, the sheet P fed from the sheet cassette 30.

The transporting section 22 includes a first roller 36, a second roller 38, a first transporting driven roller 40, a second transporting driven roller 42, a third transporting driven roller 44, a fourth transporting driven roller 46, a fifth transporting driven roller 48, and a transporting roller pair 50. The first roller 36 and the second roller 38 constitute a unit body 52 that is attachable/detachable to/from the device main body 12. In the unit body 52, a shortcut transporting pathway 54 serving as a "second medium transporting pathway" is provided between the first roller 36 and the second roller 38. The shortcut transporting pathway 54 will be described later.

Note that the unit body 52 is attachable/detachable to/from the device main body 12 from the +Y axis direction side in FIG. 2 in a state where the back cover 16 is opened with respect to the device main body 12 by moving the back cover 16 rotationally with respect to the device main body 12 in the +Y axis direction in FIG. 2. In the present embodiment, the first roller 36 and the second roller 38 are rotationally driven in a clockwise direction in FIG. 2 by a common driving source (not shown) in a state where the unit body 52 is attached to the device main body 12 and the back cover 16 is closed with respect to the device main body 12.

In the transporting section 22, the sheet P is transported to the transporting roller pair 50 along the transporting pathway 18 via the fifth transporting driven roller 48 and the third transporting driven roller 44, which make contact with the first roller 36, and the second transporting driven roller 42 and the first transporting driven roller 40, which make contact with the second roller 38. The recording section 24 is provided on the downstream side of the transporting roller pair 50 of the transporting section 22 in the transporting pathway.

The recording section 24 includes a carriage 56 that is movable in a scanning direction (the X axis direction in FIG. 2), a recording head 58 that is provided below the carriage 56 and ejects ink towards the sheet P, and a platen 60 that faces the recording head 58 and is provided so as to support the sheet P.

Furthermore, the discharging section 26 is provided on the downstream side of the recording section 24 in the transporting pathway. The discharging section 26 includes a pair of discharging rollers 62. After the sheet P is supplied from the transporting section 22 to the recording section 24 along the transporting pathway 18, recording is performed on a first face (front face) of the sheet P. After the recording, the sheet P is nipped by the discharging rollers 62, and is then discharged to a discharge stacker 66 provided on the front side of the device from the opening 64 provided on the front side of the device main body 12. The discharge stacker 66 supports the sheet P thus discharged.

Furthermore, the printer 10 includes a front feeding pathway 68 (see the alternate long and two short dashes line in FIG. 7) serving as a "merging pathway" that supplies the sheet P from the front side of the printer 10 (the −Y axis direction side in FIGS. 2 and 7) in addition to the transporting pathway 18 that starts from the medium storage section 20, passes through the transporting section 22, and reaches the recording section 24.

The front feeding pathway 68 includes a front medium supporting section 70 and a transporting path 72 located on the −Z axis direction side of the recording section 24 in FIG. 2. The front medium supporting section 70 serves as a sheet feed tray used when the sheet P is transported from the front side (the −Y axis direction side in FIG. 2) of the printer 10 to the transporting section 22. At least part of the front medium supporting section 70 supports, together with the discharge stacker 66, the sheet P when the sheet P is discharged to the discharge stacker 66.

The transporting path 72 is configured to transport the sheet P supported by the front medium supporting section 70 towards a nip point between the second roller 38 and the fourth transporting driven roller 46. The front feeding pathway 68 will be described later.

Furthermore, on the upstream side of the transporting roller pair 50 of the transporting section 22 in the transporting pathway, a medium detector 74 serving as a "detector" is provided. For example, the medium detector 74 starts detection of the sheet P and transmits a detection signal to the control section 28 when a front end of the sheet P transported along the transporting pathway 18 towards the recording section 24 passes the medium detector 74. Then, the medium detector 74 finishes detection of the sheet P and stops transmission of the detection signal to the control section 28 when a rear end of the sheet P transported towards the recording section 24 passes the medium detector 74.

In the present embodiment, for example, the control section 28 is configured (i) to cause an encoder or the like (not shown) to monitor, during a period of time from reception of the detection signal supplied from the medium detector 74 to stoppage of the reception of the detection signal, the number of rotations of the common driving source (not shown) that rotationally drives the first roller 36 and the second roller 38 in the transporting section 22 and (ii) to calculate a length of the sheet P in the transporting direction on the basis of the number of rotations thus detected.

First Embodiment

Regarding Inversion Pathway for Medium Supplied from Recording Section

Next, the following describes two inversion pathways for inverting the sheet P with reference to FIGS. 3, 5, and 6. As illustrated in FIG. 3, in the unit body 52, the shortcut transporting pathway 54 connecting a top surface 52*a* and a bottom surface 52*b* of the unit body 52 in the height direction of the unit body 52, i.e., in the Z axis direction in FIG. 3 is provided between the first roller 36 and the second roller 38.

In the embodiment, the shortcut transporting pathway 54 is curved along the second roller 38. Furthermore, on the inlet side of the shortcut transporting pathway 54, a flap 76 serving as a "switching section" is provided on the bottom surface 52*b* of the unit body 52. That is, the flap 76 is located between the first roller 36 and the second roller 38.

The flap 76 is configured to be switchable between a posture (see the state indicated by the broken line in FIG. 3) in which the inlet of the shortcut transporting pathway 54 is closed and a posture (see the state indicated by the solid line in FIG. 3) in which the inlet of the shortcut transporting pathway 54 is opened. Specifically, the posture of the flap 76 is switched by a driving source (e.g. a solenoid) (not shown) controlled by the control section 28. Hereinafter, the posture of the flap 76 in which the inlet of the shortcut transporting pathway 54 is closed is referred to as a first posture and the posture of the flap 76 in which the inlet of the shortcut transporting pathway 54 is opened is referred to as a second posture.

The following describes a switching operation between the first posture and the second posture of the flap 76. In FIG. 3, the pathway indicated by the broken line given the reference numeral 78 represents a second medium transporting pathway 78 that will be described later. The length L of the second medium transporting pathway 78 is the length of a pathway that starts from the transporting roller pair 50, passes through the shortcut transporting pathway 54, and returns to the transporting roller pair 50 again. It should be noted that, in the embodiment, for example, the length L of the second medium transporting pathway 78 is set to the length of an A4-size sheet.

The control section 28 causes the flap 76 to be in the first posture (see the state indicated by the broken line in FIG. 3) in a case where the length of the sheet P in the transporting direction which is obtained on the basis of detection information obtained by the medium detector 74 and the encoder (not shown) is longer than the length L of the second medium transporting pathway 78. Meanwhile, the control section 28 causes the flap 76 to be in the second posture (see the state indicated by the solid line in FIG. 3) in a case where the length of the sheet P in the transporting direction is equal to or shorter than the length L of the second medium transporting pathway 78.

Next, with reference to FIG. 5, the alternate long and short dash line given the reference numeral 80 represents a first medium transporting pathway 80. The sheet P is reversely fed from the recording section 24 to the transporting section 22 in order that the first face (front face) and the second face (rear face) of the sheet P be inverted. In this case, the control section 28 causes the flap 76 to be in the first posture (see the state indicated by the broken line in FIG. 3) so that the sheet P is transported along the first medium transporting pathway 80, in a case where the control section 28 judges that the length of the sheet P in the transporting direction is longer than the length L of the second medium transporting pathway 78.

Specifically, in a case where the sheet P is transported from the recording section 24 to the transporting section 22, the sheet P travels through a pre-inversion medium transporting pathway located below the bottom surface 52*b* of the unit body 52 from the −Y axis direction side towards the +Y axis direction side in FIG. 3, and the sheet P is inverted by utilizing an outer peripheral surface of the first roller 36.

Then, in the transporting section 22, the sheet P thus inverted by the first roller 36 is supplied to the recording section 24 through a post-inversion medium transporting pathway located above the top surface 52*a* of the unit body 52 from the +Y axis direction side towards the −Y axis direction side in FIG. 3. Specifically, the sheet P is transported to the transporting roller pair 50 along the first medium transporting pathway 80 via the fifth transporting driven roller 48 and the third transporting driven roller 44, which make contact with the first roller 36, and the second transporting driven roller 42 and the first transporting driven roller 40, which make contact with the second roller 38.

Then, the sheet P is supplied again to the recording section 24 located on the downstream side of the transporting roller pair 50 in the transporting direction, and in the recording section 24, recording is performed on the second face (rear face) of the sheet P. That is, the first medium transporting pathway 80 includes the pre-inversion medium transporting pathway that supplies, to the first roller 36, the sheet P supplied from the recording section 24 and the post-inversion medium transporting pathway that supplies the sheet P inverted along the first roller 36 to the recording section 24. In the embodiment, for example, the sheet P of the A3 size is inverted along the first medium transporting pathway 80.

Next, with reference to FIG. 6, the line with alternating long and two short dashes given the reference numeral 78 represents the second medium transporting pathway 78. The sheet P is reversely fed from the recording section 24 to the transporting section 22 in order that the first face (front face) and the second face (rear face) of the sheet P be inverted. In this case, the control section 28 causes the flap 76 to be in the second posture (see the state indicated by the solid line in FIG. 3) so that the sheet P is transported along the second medium transporting pathway 78, in a case where the control section 28 judges that the length of the sheet P in the transporting direction is equal to or shorter than the length L of the second medium transporting pathway 78.

Specifically, in a case where the sheet P is transported from the recording section 24 to the transporting section 22, the sheet P is transported through the pre-inversion medium transporting pathway located below the bottom surface 52*b* of the unit body 52 from the −Y axis direction side towards the +Y axis direction side in FIG. 3 and is then guided into the shortcut transporting pathway 54 by the flap 76 that is in the second posture. Then, the sheet P is inverted by passing through the shortcut transporting pathway 54.

In the transporting section 22, the sheet P thus inverted by passing through the shortcut transporting pathway 54 is supplied to the recording section 24 through the post-inversion medium transporting pathway located above the top surface 52*a* of the unit body 52 from the +Y axis direction side to the −Y axis direction side in FIG. 3. Specifically, the sheet P is transported to the transporting roller pair 50 along the second medium transporting pathway 78 via the second transporting driven roller 42 and the first transporting driven roller 40, which make contact with the second roller 38.

The sheet P is supplied again to the recording section 24 located on the downstream side of the transporting roller pair 50 in the transporting direction, and in the recording section 24, recording is performed on the second face (rear face) of the sheet P. That is, the second medium transporting pathway 78 includes (i) the pre-inversion medium transporting pathway that guides, to the shortcut transporting pathway 54, the sheet P supplied from the recording section 24 and (ii) the post-inversion medium transporting pathway that causes the sheet P to pass through the shortcut transporting pathway 54 so as to invert the sheet P and supplies the sheet P thus inverted to the recording section 24. In the embodiment, for example, the sheet P of A4 size or smaller is inverted along the second medium transporting pathway 78.

Accordingly, the printer 10 and the transporting section 22 include (i) the first medium transporting pathway 80 that causes the sheet P supplied from the recording section 24 side to be inverted along the first roller 36 and causes the sheet P thus inverted to be supplied to the recording section 24 side and (ii) the second medium transporting pathway 78 that causes the sheet P supplied from the recording section 24 to be inverted along the second roller 38 located closer to the recording section 24 than the first roller 36 and causes the sheet P thus inverted to be supplied to the recording section 24 side.

This means that, in the printer 10 and the transporting section 22, a pathway by which the sheet P is inverted can be selected in accordance with the length of the sheet P in the transporting direction. As a result, in a case where the length of the sheet P in the transporting direction is equal to or shorter than the length L of the second medium transporting pathway 78, for example, in a case where the size of the sheet P is A4 size or smaller, the second medium transporting pathway 78 is used to transport the sheet P. This makes it possible to invert the sheet P with a shorter traveling distance in a shorter period of time, as compared with a case where the first medium transporting pathway 80 is used. Therefore, the printer 10 and the transporting section 22 allow sheets of different sizes to be inverted and allow an improvement in throughput.

Furthermore, since a suitable one of the first medium transporting pathway 80 and the second medium transporting pathway 78 is used in accordance with the length of the sheet P in the transporting direction, it is possible to shorten a transporting distance of the sheet P having a length equal to or shorter than the length L. As a result, the sheet P having a length equal to or shorter than the length L does not have to travel an extra distance, whereby the sheet P having a length equal to or shorter than the length L may be transported in a shorter period of time. Therefore, the printer 10 and the transporting section 22 allow sheets of different sizes to be inverted and allow an improvement in throughput.

Furthermore, since the control section 28 switches the posture of the flap 76 between (i) the first posture in which the sheet P supplied from the recording section 24 side is transported to the first medium transporting pathway 80 and (ii) the second posture in which the sheet P supplied from the recording section 24 side is transported to the second medium transporting pathway 78, in accordance with the length of the sheet P in the transporting direction which is obtained on the basis of the detection information obtained by the medium detector 74 and the encoder (not shown), it is possible to switch the first medium transporting pathway 80 and the second medium transporting pathway 78 in accordance with the length of the sheet P in the transporting direction.

As a result, the sheet P having a length equal to or shorter than the length L does not have to travel an extra distance, whereby the sheet P having a length equal to or shorter than the length L may be transported in a shorter period of time. Therefore, the printer 10 and the transporting section 22 allow sheets of different sizes to be inverted and allow an improvement in throughput.

Furthermore, in the embodiment, it is possible to reduce a load applied to the first roller 36 since a suitable one of the first medium transporting pathway 80 and the second medium transporting pathway 78 is used as a pathway for inverting the sheet P in accordance with the length of the sheet P in the transporting direction. Specifically, since the first roller 36 heaves the sheet P up from the medium storage section 20, the first roller 36 is more liable to wear because of a larger load applied thereto as compared with the second roller 38.

That is, in a case where the sheet P having a short length in the transporting direction is inverted, use of the second medium transporting pathway 78 allows a reduction in not only load applied to the first medium transporting pathway 80 but also load applied to the first roller 36. As a result, it is possible to prolong the lifetime of the first roller 36, thereby achieving a longer lifetime for the printer 10 and the transporting section 22.

Front Feeding Pathway

Next, with reference to FIG. 7, the following describes the front feeding pathway 68 (the line with alternating long and two short dashes in FIG. 7) that transports, to the recording section 24, the sheet P supplied from the front side (the −Y axis direction side in FIG. 7) of the printer 10.

In the front feeding pathway 68, the sheet P supported by at least part of the front medium supporting section 70 and at least part of the discharge stacker 66 is transported along the transporting path 72 towards the transporting section 22 by a feeding roller 82 driven by a driving source (not shown). The transporting path 72 merges into the inversion pathway through which the sheet P is transported from the recording section 24 towards the transporting section 22. Specifically, the transporting path 72 merges into the pre-inversion medium transporting pathway of the second medium transporting pathway 78 on the upstream side, in the transporting direction, of the nip point between the second roller 38 and the fourth transporting driven roller 46 of the transporting section 22, i.e., on the recording section 24 side of the nip point.

In a case where the sheet P is supplied from the front feeding pathway 68, the sheet P travels to the transporting roller pair 50 via the front feeding pathway 68 and the second medium transporting pathway 78. Accordingly, a front end of the sheet P nipped by the transporting roller pair 50 does not overlap a rear end of the sheet P regardless of the length of the sheet P in the transporting direction.

Therefore, in a case where the sheet P is supplied from the front feeding pathway 68, the control section 28 switches the posture of the flap 76 to the second posture so that the sheet P is guided from the front feeding pathway 68 to the second medium transporting pathway 78 and is then transported to the recording section 24. In the recording section 24, recording is performed on the first face (front face) of the sheet P. In a case where two-sided recording is not performed, the sheet P is transported towards the discharging section 26.

Next, the following describes an inversion pathway taken in a case where two-sided recording is performed on the sheet P supplied from the front feeding pathway 68 to the recording section 24 via the second medium transporting pathway 78. In a case where the sheet P is supplied from the front feeding pathway 68 to the recording section 24 via the second medium transporting pathway 78, the control section 28 causes the medium detector 74 to detect the sheet P. In a case where recording is performed on the second face (rear face) of the sheet P, the control section 28 calculates the length of the sheet P in the transporting direction on the basis of the detection information obtained by the medium detector 74 and the encoder (not shown).

In a case where the length of the sheet P in the transporting direction is longer than the length L of the second medium transporting pathway 78, the control section 28 causes the flap 76 to be in the first posture (see the state indicated by the broken line in FIG. 3) so that the sheet P is transported along the first medium transporting pathway 80. Meanwhile, in a case where the length of the sheet P in the transporting direction is equal to or shorter than the length L of the second medium transporting pathway 78, the control section 28 causes the flap 76 to be in the second posture (see the state indicated by the solid line in FIG. 3) so that the sheet P is transported along the second medium transporting pathway 78.

Regardless of the length in the transporting direction, the sheet P supplied from the front feeding pathway 68 is transported to the recording section 24 along the second medium transporting pathway 78 through the shortcut transporting pathway 54 that serves as a short-cut passing between the first roller 36 and the second roller 38. This achieves a shorter transporting distance, thereby allowing the sheet P to be transported in a shorter period of time, as compared with a case where the sheet P is transported to the recording section 24 through the first medium transporting pathway 80. As a result, it is possible to shorten a period of time required for recording on the sheet P supplied from the front feeding pathway 68 and to improve throughput achieved in a case where the sheet P is supplied from the front feeding pathway 68.

Furthermore, the front feeding pathway 68 merges into the pre-inversion medium transporting pathway of the second medium transporting pathway 78 at a point closer to the recording section 24 than the second roller. This allows the sheet P transported from the front feeding pathway 68 to be transported to the recording section 24 via the second medium transporting pathway 78. As a result, the length of the pathway from the front feeding pathway 68 to the recording section 24 is shorter as compared with a case where the sheet P passes through the first medium transporting pathway 80. This allows the sheet P to be transported in a shorter period of time, thereby allowing an improvement in throughput achieved in a case where the sheet P is supplied from the front feeding pathway 68.

Furthermore, since the control section 28 switches the posture of the flap 76 on the basis of information on the length of the sheet P detected by the medium detector 74, it is possible to select a medium transporting pathway corresponding to the length of the sheet P. As a result, the printer 10 and the transporting section 22 allow sheets of different sizes to be inverted and allow an improvement in throughput.

Modification of First Embodiment (1) In the embodiment, an arrangement in which the shortcut transporting pathway 54 is a pathway for inverting the sheet P along the second roller 38 has been described. Note, however, that it is only necessary that the shortcut transporting pathway 54 be located between the first roller 36 and the second roller 38.

(2) In the embodiment, an arrangement in which the flap 76 is provided on the bottom surface 52*b* of the unit body 52 in the transporting section 22 has been described. Note, however, that instead of this arrangement, a flap 84 may be provided on the device main body 12 side at a position facing the inlet of the shortcut transporting pathway 54 on the bottom surface 52*b* of the unit body 52, as illustrated in FIG. 8.

(3) In the embodiment, an arrangement in which in a case where the length of the sheet P in the transporting direction is equal to or shorter than the length L of the second medium transporting pathway 78, the sheet P is transported along the second medium transporting pathway 78 has been described. Note, however, that instead of this arrangement, the sheet P may be transported along the first medium transporting pathway 80 under control of the control section 28 depending on a printing duty, an ink drying time, whether high-density recording is executed, or the like even in a case where the length of the sheet P is equal to or shorter than the length L.

The following is a summary of the above descriptions. A transporting section 22 of the embodiment includes: a first roller 36 that inverts a sheet P supplied from a recording section 24 side, the recording section 24 processing the sheet P; a second roller 38 that is located closer to the recording section 24 than the first roller 36, the second roller 38 having a function of inverting the sheet P supplied from the recording section 24 side and a function of applying a transporting force to the medium using its outer peripheral surface facing both of a pre-inversion medium transporting pathway for transporting a medium that has not been inverted by the first roller 36 and a post-inversion medium transporting pathway for transporting a medium that has been inverted by the first roller; a first medium transporting pathway 80 that causes the sheet P supplied from the recording section 24 side to be inverted along the first roller 36 and causes the sheet P thus inverted to be supplied to the recording section 24 side; a second medium transporting pathway 78 that causes the sheet P supplied from the recording section 24 side to be inverted along the second roller 38 and causes the sheet P thus inverted to be supplied to the recording section 24 side; and a front feeding pathway 68 that merges into the pre-inversion medium transporting pathway of the second medium transporting pathway 78 so as to supply the sheet P to the second roller 38. The sheet P transported from the front feeding pathway 68 is transported to the recording section 24 through the second medium transporting pathway 78.

A transporting section 22 includes a first roller 36 that inverts a sheet P supplied from a recording section 24 side, the recording section 24 processing the sheet P; a second roller 38 that is located closer to the recording section 24 than the first roller 36, the second roller 38 having a function of inverting the sheet P supplied from the recording section 24 side and a function of applying a transporting force to the medium using its outer peripheral surface facing both of a pre-inversion medium transporting pathway for transporting a medium that has not been inverted by the first roller 36 and a post-inversion medium transporting pathway for transporting a medium that has been inverted by the first roller 36; a first medium transporting pathway 80 that causes the sheet P supplied from the recording section 24 side to be inverted along the first roller 36 and causes the sheet P thus inverted to be supplied to the recording section 24 side; a second medium transporting pathway 78 that serves as a short-cut allowing the sheet P supplied from the recording section 24 side to travel between the first roller 36 and the second roller 38 and to be supplied to the recording section 24 side; and a front feeding pathway 68 that merges into the pre-inversion medium transporting pathway of the second medium transporting pathway 78 so as to supply the sheet P to the second roller 38. The sheet P transported from the front feeding pathway 68 is transported to the recording section 24 through the second medium transporting pathway 78.

The transporting section 22 includes a transporting roller pair 50 located between the recording section 24 and the second roller 38. In a case where the length of the sheet P in a transporting direction is longer than a length L of a pathway starting from the transporting roller pair 50, passing through the second medium transporting pathway 78, and returning to the transporting roller pair 50, the sheet P supplied from the recording section 24 side is transported by the first medium transporting pathway 80. In a case where the length of the sheet P in the transporting direction is equal to or shorter than the length L of the pathway starting from the transporting roller pair 50, passing through the second medium transporting pathway 78, and returning to the transporting roller pair 50, the sheet P supplied from the recording section 24 side is transported by the second medium transporting pathway 78.

The transporting section 22 includes a flap 76 or 84 that is located between the first roller 36 and the second roller 38 and that is switchable between a first posture in which the sheet P supplied from the recording section 24 side is transported to the first medium transporting pathway 80 and a second posture in which the sheet P supplied from the recording section 24 side is transported to the second medium transporting pathway 78.

A printer 10 includes a recording section 24 that processes a sheet P and a transporting section 22. In the printer 10, the front feeding pathway 68 merges, on the second roller 38 side, into the pre-inversion medium transporting pathway of the second medium transporting pathway 78.

Alternatively, a printer 10 includes a recording section 24 that processes a sheet P; a transporting section 22 in which a flap 76 or 84 is provided; a control section 28 that controls the transporting section 22; and a medium detector 74 that detects the sheet P. The control section 28 switches the first posture and the second posture of the flap 76 or 84 on the basis of the length of the sheet P in the transporting direction detected by the medium detector 74.

Although, in the embodiment, an example has been given in which the transporting section 22 according to the invention is applied to an inkjet printer, which is one example of a recording apparatus, the transporting section 22 can be applied to other liquid ejecting devices in general.

The "liquid ejecting devices" as used herein encompass not only recording apparatuses, such as printers, copying machines, and facsimiles, that use an ink jet type recording head to eject ink so that recording is performed on a recording target medium, but also apparatuses that causes a liquid ejecting head corresponding to an ink jet type recording head to eject, instead of ink, liquid corresponding to ink onto an ejection target medium corresponding to the recording target medium so that the liquid is applied to the ejection target medium.

Examples of the liquid ejecting head include, in addition to the recording head, a color material ejecting head to be used for production of color filters for use in liquid crystal displays or the like, an electrode material (conductive paste) ejecting head to be used for formation of electrodes for use in organic EL displays, surface light emitting displays (FEDs) or the like, a bioorganic material ejecting head to be used for production of biochips, and a sample ejecting head to be used as a precision pipette.

Needless to say, the invention is not limited to the above embodiment and can be modified in various ways within the scope of the invention described in the claims, and such modifications are also encompassed within the scope of the invention.

The entire disclosure of Japanese Patent Application No.: 2013-207081, filed Oct. 2, 2013 and 2013-207080, filed Oct. 2, 2013 are expressly incorporated by reference herein.

What is claimed is:

1. A medium transporting device comprising:

a first roller that inverts a medium supplied from a processing section side, the processing section side being downstream the first roller in relation to a first direction of movement of the medium from a storage section toward the first roller;

a second roller that is located closer to the processing section than the first roller, with the processing section side being downstream the first roller, the second roller having a function of inverting the medium supplied from the processing section side and a function of applying a transporting force to the medium using an outer peripheral surface of the second roller that faces both a pre-inversion medium transporting pathway for transporting a medium that has not been inverted by the first roller and a post-inversion medium transporting pathway for transporting a medium that has been inverted by the first roller;

a first medium transporting pathway that causes the medium supplied from the processing section side to be inverted along the first roller and causes the medium thus inverted to be supplied to the processing section side; and a second medium transporting pathway that causes the medium supplied from the processing section side to be inverted along the second roller and causes the medium thus inverted to be supplied to the processing section side.

2. The medium transporting device according to claim 1, further comprising a merging pathway that merges into the pre-inversion medium transporting pathway so that the medium is supplied to the second roller, wherein the medium transported from the merging pathway is transported to the processing section through the second medium transporting pathway.

3. The medium transporting device according to claim 2, further comprising a switching section provided between the first roller and the second roller, the switching section being switchable between a first posture in which the medium supplied from the processing section side is transported to the first medium transporting pathway and a second posture in which the medium supplied from the processing section side is transported to the second medium transporting pathway.

4. A recording apparatus comprising:

a processing section that processes a medium;

the medium transporting device as set forth in claim 3;

a control section that controls the medium transporting device; and a detector that detects the medium, wherein the merging pathway merges into the pre-inversion medium transporting pathway at a position closer to the processing section than the second roller, and the control section switches the first posture and the second posture of the switching section on the basis of the length, in the transporting direction, of the medium detected by the detector.

5. A recording apparatus comprising:

a processing section that processes a medium; and the medium transporting device as set forth in claim 2.

6. The recording apparatus according to claim 5, wherein the merging pathway merges into the pre-inversion medium transporting pathway at a position closer to the processing section than the second roller.

7. The medium transporting device according to claim 1, further comprising a transporting roller pair located between the processing section and the second roller, wherein in a case where a length of the medium in a transporting direction is longer than a length of a pathway starting from the transporting roller pair, passing through the second medium transporting pathway, and returning to the transporting roller pair, the medium supplied from the processing section side is transported by the first medium transporting pathway, and in a case where the length of the medium in the transporting direction is equal to or shorter than the length of the pathway starting from the transporting roller pair, passing through the second medium transporting pathway, and returning to the transporting roller pair, the medium supplied from the processing section side is transported by the second medium transporting pathway.

8. The medium transporting device according to claim 1, further comprising a switching section provided between the first roller and the second roller, the switching section being switchable between a first posture in which the medium supplied from the processing section side is transported to the first medium transporting pathway and a second posture in which the medium supplied from the processing section side is transported to the second medium transporting pathway.

9. A recording apparatus comprising:

a processing section that processes a medium; and the medium transporting device as set forth in claim 1.

10. A medium transporting device comprising:

a first roller that inverts a medium supplied from a processing section side, the processing section side being downstream the first roller in relation to a first direction of movement of the medium from a storage section toward the first roller;

a second roller that is located closer to the processing section than the first roller, with the processing section side being downstream the first roller, the second roller having a function of inverting the medium supplied from the processing section side and a function of applying a transporting force to the medium using an outer peripheral surface of the second roller that faces both a pre-inversion medium transporting pathway for transporting a medium that has not been inverted by the first roller and a post-inversion medium transporting pathway for transporting a medium that has been inverted by the first roller;

a first medium transporting pathway that causes the medium supplied from the processing section side to be inverted along the first roller and causes the medium thus inverted to be supplied to the processing section side; and a second medium transporting pathway that serves as a short-cut allowing the medium supplied from the processing section to travel between the first roller and the second roller and to be supplied to the processing section side.

* * * * *